US006209962B1

(12) United States Patent
Sobel et al.

(10) Patent No.: US 6,209,962 B1
(45) Date of Patent: Apr. 3, 2001

(54) FREE FORM FURNITURE

(76) Inventors: Allen Sobel, 132 Murriverie Road, N. Bondi Beach, NSW 2026 (AU); Melvin Sobel, 2085 Harts Rd., Conshohocken, PA (US) 19428

( * ) Notice: Subject to any disclaimer, the term of this patent is extended or adjusted under 35 U.S.C. 154(b) by 0 days.

(21) Appl. No.: 09/273,103

(22) Filed: Mar. 19, 1999

(30) Foreign Application Priority Data

Dec. 15, 1998 (RU) ..... 98123551

(51) Int. Cl.[7] ..... A47C 7/02

(52) U.S. Cl. ..... 297/452.17; 297/452.41; 297/DIG. 3

(58) Field of Search ..... 297/452.17, 452.41, 297/DIG. 3, 284.1; 5/702, 655.4

(56) References Cited

U.S. PATENT DOCUMENTS

| | | | |
|---|---|---|---|
| Re. 29,059 | | 12/1976 | Kack et al. . |
| 587,224 | * | 7/1897 | McKelvey . |
| 2,987,735 | * | 6/1961 | Nail . |
| 3,529,306 | * | 9/1970 | Thorne . |
| 3,899,210 | | 8/1975 | Samhammer . |
| 4,027,888 | * | 6/1977 | Wilcox . |
| 4,045,830 | | 9/1977 | Loeb et al. . |
| 4,213,213 | * | 7/1980 | Burnett . |
| 4,281,873 | * | 8/1981 | Holland . |
| 4,514,010 | * | 4/1985 | Gonzalez . |
| 4,875,732 | * | 10/1989 | Miller . |
| 5,154,185 | * | 10/1992 | Latimer et al. . |
| 5,556,169 | * | 9/1996 | Parrish et al. . |
| 5,733,012 | * | 3/1998 | Jones . |
| 5,806,928 | * | 9/1998 | Gattuso et al. . |

FOREIGN PATENT DOCUMENTS

| | | | | |
|---|---|---|---|---|
| 567176 | | 1/1985 | (AU) . | |
| 2059758 | * | 4/1981 | (GB) | 297/452.17 |
| 2059758 | | 10/1983 | (GB) . | |
| 2214071 | * | 8/1989 | (GB) | 5/655.4 |

* cited by examiner

*Primary Examiner*—Milton Nelson, Jr.
(74) *Attorney, Agent, or Firm*—Stuart E. Beck

(57) ABSTRACT

An upholstery furniture item comprising a casing of flexible non-air permeable material filled with a spherical beads of expanded polystyrene that flow around the body of a person seated in the item to closely follow the contours of the body as described earlier. In the bottom of the casing is an airtight inflatable air chamber for compensating for volume changes that arise from the crushing or abrading of the beads after repeated uses. Flexible elastic members are provided to help the furniture item retain its shape.

16 Claims, 2 Drawing Sheets

FREE FORM FURNITURE

FIELD OF THE INVENTION

This invention relates to free form upholstered seating.

BACKGROUND OF THE INVENTION

Free form identifies a type of seating that includes a casing in the shape of an upholstered chair with no frame. The casing may be made of flexible non-air permeable material such as genuine or artificial leather, plastic, fabric with a coated backing or the like that is partially filled with a filler material such as pieces of expanded polystyrene of various sizes and shapes that can move in the casing under the pressure created by the weight of a seated person.

Under the weight of the seated person the filler is rearranged in the casing by flowing to areas under lower pressure. Therefore, the shape of the casing changes to conform to the shape of the person's body. This customizes the seat to that person's particular body size and shape thereby increasing its comfort.

Free form furniture is advantageous compared to the traditional upholstered furniture since it is relatively simple to make, has low production cost, low weight and high comfort.

In Australian Patent No. 62106/80, an upholstered chair is disclosed that has a casing comprised of flexible, non-stretchable material that is partly filled by flowable particles of styropor. The upper part of the chair forms its seat and continues to form its back and arms. The sides of chair comprise bands of material having different widths which are sewn to the upper and lower parts of the casing.

Flexible non-stretching panels which may be made from non-stretchable sheet-type material are provided to limit the change in the chair's shape when a person sits in it. One panel is generally vertical with one of its edges sewn into the inside surface of the lower part of the casing. Its other edge sewn into the internal part of upper part of the casing where the seat contacts the back. This panel prevents the back part of the seat from rising. This results in the styropor beads flowing under the influence of the weight of the body of the person sitting on the chair.

The second panel is generally horizontal with its edges sewn to the opposite parts of the interior of the sides of the casing. This panel prevents the sides of the casing from stretching under the force of the flowing styropor beads when the seat is loaded, i.e., it limits the enlargement of the cross-section of the seat.

However, after a person leaves the chair it does not return to its original form. This is because the beads that were under pressure from the weight of the sitting person do not return to their former locations in the casing when the person leaves the chair.

Therefore, when the chair is used again, it is necessary to "bulk-up" the chair to its original form by returning the beads to the zones emptied previously. This can be done by hand, or by sitting in it and moving the body to re-spread the beads.

This deficiency is partly overcome by the item described in Russian Patent No. 2,093,057 which has means which enable the beads to return to their original locations after use. This item employs flexible elastic panels that not only define and limit the change in shape of the item, but also help the item to return to its original shape after use.

Moreover, when the elastic panels stretch under a load they create additional volume inside the casing where the beads flow. This occurs because when the casing is loaded by the weight of a person, the elastic panels are deformed. However, when the load is removed the elastic panels return to their original length and the parts of the casing to which they are connected urge the beads to return to the zones which they left under the influence of the load (weight of the sitting person).

However, the Australian and Russian patents are similar since they both disclose a furniture item having a casing made from elastic flexible material with at least one panel inside the casing that is connected at its edges to the upper and lower parts of the casing, and at least one flexible panel which is connected between the sides of the casing.

Moreover, in one instance the flexible panel is fixed to the side of the casing on the perimeter of its cross-section. In another instance flexible panels are fixed the sides of the casing and extend crosswise to the opposite internal surfaces of the side of the casing.

At least one non-stretchable element may be connected to the flexible elastic panel to limit its range of extension and thus limit the change of shape of the item.

None-the-less, even with these features, after repeated uses the beads are crushed to a reduced size and as a result, the total volume of filler in the item is reduced. As less and less of the casing is filled, its shape changes and it becomes less comfortable and less attractive to view.

The change in form is more pronounced at the bottom of the item since the beads in the bottom contact the hard surface of the floor through the material of the bottom part of the furniture item.

Therefore, it is necessary to periodically add additional beads to enable the item to return to its original form. This increases the cost of maintaining the item. For example, if a casing has an internal volume of 100 liters and is 90% filled by beads, and after continuous using (many loadings of the seat) the volume of the beads has dropped by 20%, and as a result the form of the item has changed, 18 liters of beads must be added to compensate for this drop in volume and change of shape. It is obvious that during the life of the item it will be necessary to add the beads several times. This uncomfortable for the person seated. Further, this will increase the weight of the item making it more difficult to move. Still further, maintenance expense may come close to the cost of thee item.

It would be advantageous to provide a filler material that flows smoothly so that the seat would to customize itself to a person's particular body size and shape thereby increasing its comfort.

Further, it would be advantageous if the reduction in volume of the filler material could be compensated for simply and easily without having to open the casing to add filler material.

SUMMARY OF THE INVENTION

With the foregoing in mind the invention relates to a furniture item of the type described which can be returned to its original shape after repeated loadings over a long period while avoiding the necessity for adding particles of the filling agent.

It includes a non-stretchable, non-air permeable casing in the form of the item that is substantially filled with spherical beads of expanded polystyrene that are flowable under the weight of a person sitting on the item. The casing contains panels connected across the interior of the casing that limit the extent to which the item can change form under the force of the flowing particles. Further, the furniture item includes an inflatable means to compensate for changes of the volume of particles inside the casing that results from long-time and/or repeated loadings of the seat of the furniture item. The inflatable means permits the shape and hardness of the item to be adjusted in accordance with desired comfort by increasing or reducing the volume and correspondingly the extent to which the casing is filled.

The invention is useful for ottomans, stools, chairs and sofas of different sizes and forms.

DETAILED DESCRIPTION OF A PREFERRED FORM OF THE INVENTION

Figure 1A:
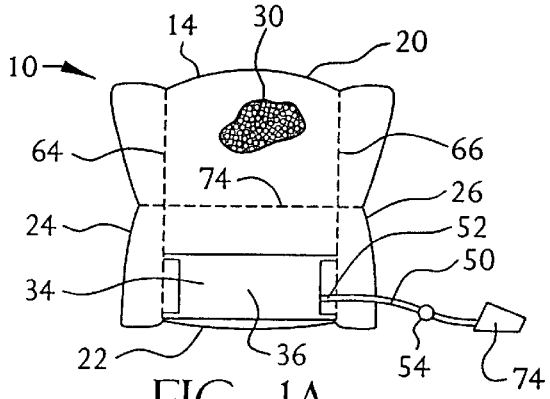
FIG. 1A is a front view of a furniture item made in accordance with a presently preferred form of the invention before it is loaded.
Figure 2A:
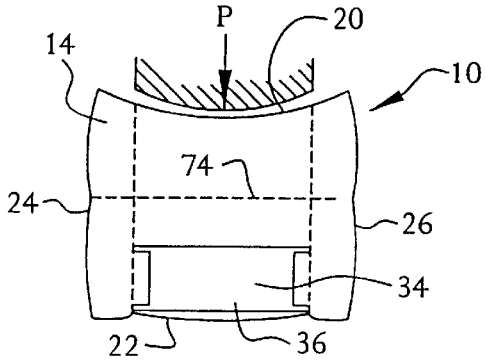
FIG. 2A is a front view of the furniture item of FIGS. 1A and 1B with a force "P" loading the seat.
Figure 1B:
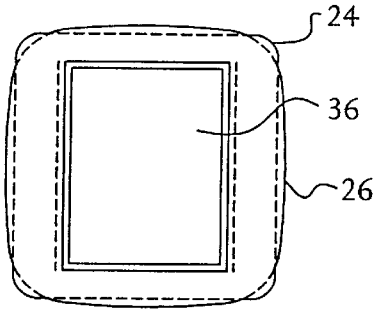
FIG. 1B is a plan view of the furniture item illustrated in FIG. 1A.
Figure 2B:
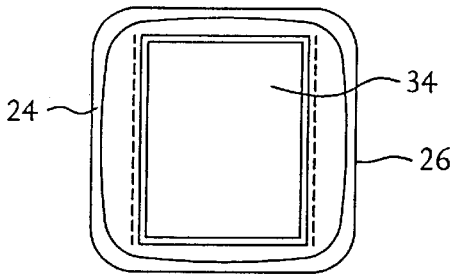
FIG. 2B is a plan view of the furniture item illustrated in FIG. 2A.

As best seen in FIG. 1 the one presently preferred form of the upholstery furniture item 10 may be a stool or ottoman comprises an non-air permeable, non-stretchable casing 14 made from flexible material such as natural or artificial leather, plastic,fabric with coated backing or the like. It includes upper 20, bottom 22 and side parts 24 and 26 which are connected to each other in a suitable manner such as by being sewn or glued to define the shape of the item 10.

The casing 14 is filled with flowable particles such as spherical beads 30 of expanded polystyrene that are flowable under the weight of a person sitting on the item in a manner similar to ball bearings. The beads 30 preferably have a diameter of about three to four millimeters. While the precise size of the beads 30 is not critical, it should be appreciated that if the diameter of the beads is less than about three millimeters, their ability to flow will be diminished. On the other hand if their diameter is much larger than four millimeters, their outlines will be visible through the casing thereby giving the item an unattractive pimply appearance.

As is well understood, the beads 30 described are especially advantageous since because of their size and shape they flow around the body of a person seated in the item so that the casing 14 closely follows the contours of the body.

Figure 3A:
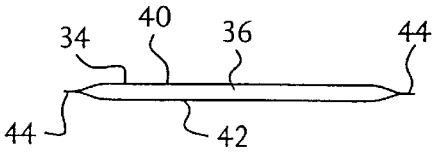
FIGS. 3A and 3B are cross-section views of a preferred form of the means for compensating for volume changes of the furniture item.
Figure 3B:
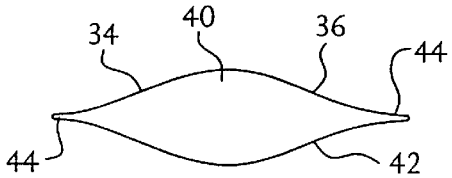

In the bottom part 22 of the casing 14 is a means 34 for compensating for volume changes that arise from repeated uses or for changing the shape or hardness of the item 10 to increase its comfort. As seen in FIGS. 3A and 3B, the means 34 may be an airtight inflatable air chamber 36. The chamber 36 may be formed from two sheets 40 and 42 of air impervious flexible material which have been glued or heat sealed to each other around their perimeters 44. The chamber may be connected to the interior of the casing so that its movement is limited.

The air chamber 36 includes a tube 50 through which it can be inflated and deflated. Preferably, one end 52 of the tube 50 may be connected to the interior of the air chamber 36 in airtight manner.

The tube 50 includes a yieldable check valve 54 having a flap (not shown) which rests against the inner wall of the tube 40 in a well known manner. The flap yields to permit air to enter the air chamber 36. When the flap is flexed as by manually squeezing the tube, air is permitted to escape from the air chamber.

Inside the casing 14 and in overlying relation to the air chamber 36 is a layer of the aforementioned spherical beads 30 of expanded polystyrene. Preferably, the layer of the beads is thick enough to provide for the comfort for the sitting person.

In the presently preferred form of the invention the air chamber 36 is located at or near the bottom of the casing 14 with the beads being above it in the upper part of the casing.

Further, inside the casing 14 are suitable means for limiting the its ability to change from its original form when it is loaded as for example when sat upon by a person. The means comprise vertically extending flexible panels 64 and 66 made from a suitable elastic material such as LYCRA. The edges of the panels 64 and 66 are fixed by, for example, being sewn, to the interior of the upper 20 and bottom 22 parts of the casing 14.

At least one horizontally extending elastic flexible panel 74 is connected to the interior of the sides 24 and 26 by being sewn, glued or in some other suitable manner. Panels 64 and 66 help the casing 14 to retain its shape when it is not loaded. Elastic flexible panel 74 yields to enable the side parts 22 and 24 of the casing to deform under the weight of a person and to enable the beads 30 to flow under the person's body.

When the item 10 is not used, i.e., the upper part 20 is not loaded, the forces created by the panels 64, 66 and 74 are compensated for by the resistance of the beads 30 and the elasticity of the air chamber 36 since the air chamber is pressurized.

The quantity of beads 30 and the volume of air inside the chamber 36 after initially adding air if necessary are such that the furniture item 10 in its free form unloaded state has the desired aesthetic and ergonomically suitable form.

In a preferred form of the invention, the spherical beads of expanded polystyrene 30 initially comprise about 60% of the total internal volume of the casing. The volume of the air chamber 36, when it is completely filled comprises, may comprise about 30% of the total volume of the casing. Therefore, the volume of the casing filled by both the air chamber 36 at maximum volume and the expanded polystyrene beads comprise 90% of the volume of the casing $V_{max}$. Initially, before the beads 30 are subjected to the load of a seated person, the air chamber 36 may preferably not be inflated or may be only partially inflated such as to about 5% of $V_{max}$.

When the furniture item 10 is loaded by the weight of the person P, the horizontally extending elastic flexible panels or panels 74 stretch and the beads 30 flow from the areas of high pressure to the areas of low pressure and the upper part of the furniture item casing adapts to the body shape of the sitting person.

In comparison to the prior art furniture items described above, the lower layer of beads is not in direct contact with the hard floor surface through the bottom of the casing, but is in contact with the flexible upper surface of the air chamber 36. Therefore, the force applied to the beads 30 is reduced and they will retain their original size for longer periods.

None-the-less, after long periods of use and multiple loadings, the beads 30 are crushed and are abraded so that the level of filling material in the casing 14 is reduced and its aesthetic and ergonomical features deteriorate. To compensate for these changes and to return the casing to its original size and shape, the internal volume of the air chamber 36 is increased by simply adding the air. This is accomplished by merely breathing into tube 50 as if inflating a balloon, or by using a small hand pump 74. The hand pump 74 is connected to the distal end of tube 50. As explained earlier, leakage of air and controlled deflation of air chamber 36 is controlled by check valve 54.

Figure 4A:
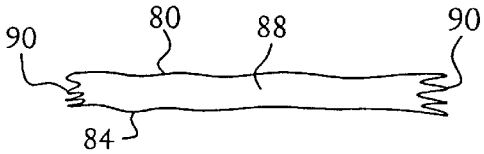
FIGS. 4A and 4B are cross-sectional views of another preferred form of the means for compensating for volume changes of the furniture item.
Figure 4B:
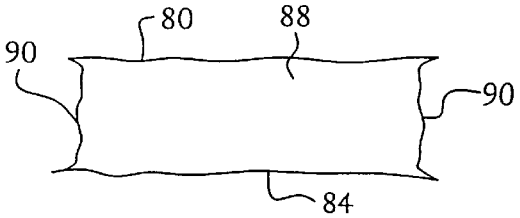

FIG. 4A shows an alternate form of the airtight inflatable air chamber 80 deflated while FIG. 4B shows the airtight inflatable air chamber 80 inflated. The air chamber 80 includes airtight rigid bottom and top sheets 84 and 88 that can be made from hard light weight materials such as plastics or light weight metals such as aluminum.

The bottom and top sheets 84 and 88 are connected in an airtight manner by flexible side walls 90. As seen in FIG. 4A, when the air chamber 80 is deflated or substantially deflated, the side walls 90 can fold on themselves to permit the bottom and top sheets 84 and 88 to come close to each other so that the air chamber 80 takes less space and so that the casing 14 can be filled with beads 30.

Further, the bottom sheet 84 may comprise the bottom of the casing 14 or it may be directly connected to it. As seen in FIG. 4B, when the airtight inflatable air chamber 80 is inflated while in the casing 14, the top sheet 88 rises evenly thereby lifting the layer of beads 30 over it to reduce the volume of free space within the casing 14.

Figure 5:
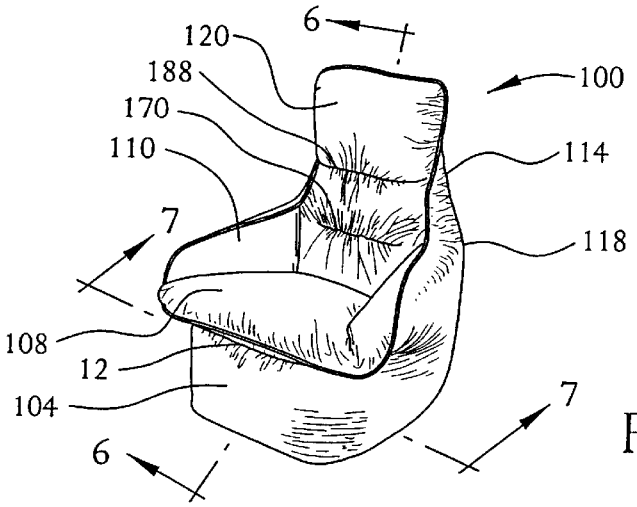
FIG. 5 is a perspective view of a another furniture item made in accordance with a presently preferred form of the invention before it is loaded.

In the embodiment of the invention shown in FIG. 5 the invention can be advantageously used to create a chair 100.

As best seen in FIG. 5, the chair 100 which is filled with the small spherical beads 30 of expanded polystyrene that can flow under the pressure created by the weight of a seated person comprises a base 104, a seat 108, arms 110 (if desired) and a back 114. The shape of the chair is defined by casing 118 which may be formed from a plurality of air permeable pieces that are assembled by being sewn to each other or by an adhesive to create a chair 100 having the desired configuration.

The chair 100 is further defined by the junctures of adjacent pieces and by internal flexible elastic panels as will be more fully described.

Figure 6:
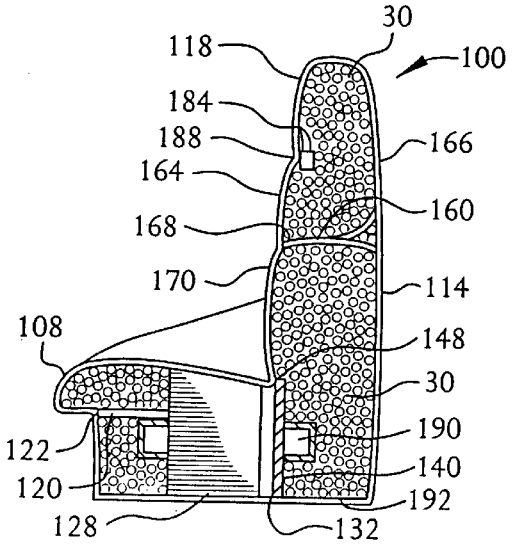
FIG. 6 is a section view taken along line 6—6 of FIG. 5.

As seen in FIGS. 5 and 6, the juncture 122 of the base 104 and seat 108 is defined by a narrow strip of elastic material 120. The strip of elastic material is attached to the juncture 122 while it is stretched. Therefore, when it is released, it gathers the casing 118 at the juncture 122 so that the front of seat 108 overhangs the base 104.

Figure 7:
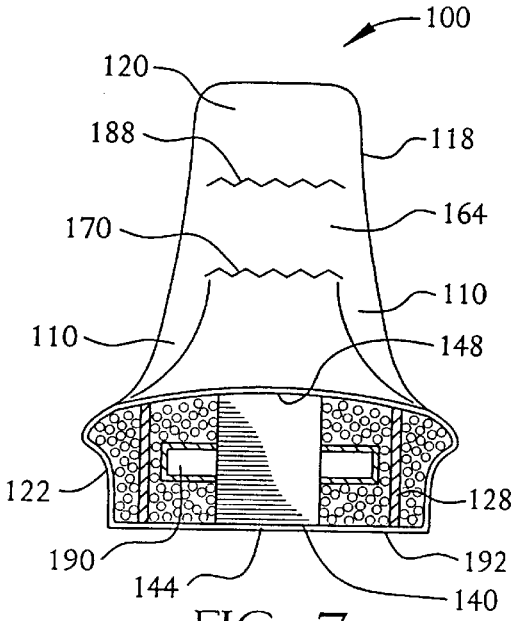
FIG. 7 is a partial section view taken along line 7—7 of FIG. 5.

As seen in FIGS. 6 and 7, two vertical panels of flexible elastic material 128 such as LYCRA are connected between the bottom 132 of the base 104 and the arms 110 and the seat 108. The panels 128 are generally rectangular in shape and are generally vertically positioned with one end 130 being secured to the bottom 132 and their other ends 134 being connected to the underside of the seat 108 so that they lie under the outer lateral edges of the seat 108 in planes that are substantially parallel to the longitudinal axis of the chair 110.

As will be appreciated more fully, the vertical panels 128 function in generally the same way as the vertical panels 64 and 66 described above to help the chair retain its shape by acting against any tendency of the beads of expanded polystyrene and the compensating means to push the chair out of shape as will be more fully described, when it is not being used Additionally, further retention of the shape of the chair 100 is provided by the inclusion of a further rectangular panel 140. Panel 140 may be comprised of a flexible elastic material such as LYCRA. Panel 140 lies in a plane that is substantially parallel to the lateral axis of the chair. Its lower end 144 is connected to the bottom 128 of the base 104 and extends upwardly with its upper end 148 connected to the juncture of the seat 108 and the back 114.

If desired, a horizontally disposed transverse flexible elastic panel (not shown) can be provided. This panel may be comprised of a flexible elastic material such as LYCRA.

Its ends can be connected to the inside of the casing 118 below the seat 108. The horizontal panel can be used in a manner similar to panels or panels 74 to help the base 104 of the chair 100 resist spreading when a person sits on it and to return to its original shape when that person rises.

A further rectangular panel of flexible elastic material 160 such as LYCRA extends between the front and rear walls 164 and 166 that comprise the back 114 of the chair 100.

Figure 8:
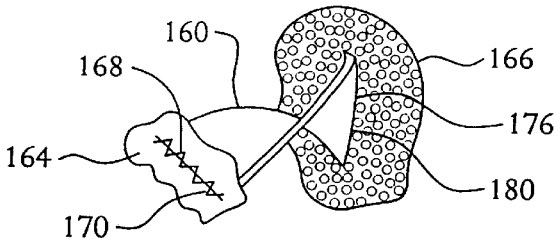
FIG. 8 is a view of a detail of the furniture item illustrated in FIG. 5.

As best seen in FIGS. 6 and 8, the front edge 168 of panel 160 is connected to the front wall 164 of chair back 114 by an adhesive, stitching or other suitable means so that it lies in a horizontal plane. The panel is stretched before it is attached to front wall 164 so that when it is released the material of the front wall 164 gathers to provide a horizontal line 170 which helps to define the shape of the back 114.

The rear edge 176 of panel 160 is connected to the rear wall 166 of chair back 114 along a centrally located and vertically extending seam 180 in a manner similar to that described with respect to line 170 so that it lies in a vertical plane.

Panel 168 is used advantageously to help the back 114 of the chair 100 retain its shape. Thus, if it were not present, the beads would urge the front and rear walls 164 and 166 of the back 114 to separate. Thus, the front wall 164, instead of presenting a flat back supporting surface would become convex thereby diminishing the support that it would provide for a person sitting in the chair.

The shape of the back 114 is further maintained by a strip of flexible elastic material 184 which is stretched in a horizontal direction before it is attached to the front wall 164. In a manner similar to that described, when the strip of material 184 is relaxed, it gathers the material of the front wall to form the horizontal line 188 seen in FIGS. 5 and 7.

The shape of the casing, the panels of flexible elastic material and the flowable beads 30 cooperate to provide useful ergonomic features for the chair. Thus, since the beads are flowable, they tend to move into the back and sides of the chair when a person sits in it thereby providing support for those parts of the person's body. Further, since the lower part of the back is filled with beads 30 before the upper part, additional support for the lumbar section of the back is provided.

Further, the flowable beads permit the back of the chair to be pushed to an almost horizontal position with the "excess" beads flowing to the front of the seat. Thus, the chair, even though it does not have a frame, functions in a manner similar to a recliner with a frame while at the same time providing positive support for the lower back.

Still further, if when arising from the chair, the person leans forward, beads 30 flow into the back 114 making it erect.

In addition, the chair 100 includes a means 190 for compensating for volume changes (briefly referred to above) resulting from the beads being crushed after repeated uses that arise from repeated uses or for changing the shape or hardness of the chair 100 to increase its comfort. The means 190 may comprise one or more inflatable air chambers of the type 34 described above which can be inflated by the person seated by the means described in the description of compensating means 34.

The compensating means 190 may be disposed in the base 104. If only one compensating means 190 is used it is preferably disposed near the bottom wall 192 of the base 104 or it can be made integral with the bottom wall 192 so that the bottom wall comprises one of the sides of the compensating means. As explained earlier, placing the compensating means at the bottom of the base 104 tends to protect the beads from being further crushed since they are not in contact with a hard flooring surface.

Further, the compensating means 190 could be at an intermediate location in the base or near the seat 108 without departing from the scope and spirit of the invention.

Still further, additional compensating means may be placed near the juncture of the back 114 and seat 108.

In manner similar to that described with regard to the form of the invention illustrated in FIG. 1, the volume of beads lost when they are crushed is compensated for inflating the compensating means 190. When the volume of beads in the back 114 of the chair is reduced to the extent that the back is no longer capable of providing support, merely rolling it on the floor and inflating the compensating means will refill it with beads.

While several furniture items comprising forms of the invention have been described, it is apparent that other furniture items such as sofas and the like could be provided. Further, several inflatable tanks, each being located at a different place inside the furniture item could be used. Still further, the air chambers could be separate from each other so that each can be inflated to a different volume, or they could be connected to each other so that they are filled simultaneously and to the same extent.

Further, it is apparent that still other forms and embodiments of the invention will be obvious to those skilled in the art from the foregoing description. Thus, the scope of the invention should not be limited by the description, but rather, only by the scope of the appended claims.

What is claimed is:

1. A freeform furniture item comprising a casing comprised of a flexible non-air permeable material, said casing including upper, bottom and middle parts, said middle part connecting said upper and bottom parts, a first volume of flowable particles substantially filling said upper, bottom and middle parts of said casing and being flowable between said parts when a person sits on said item to accommodate the body of that person, horizontally and vertically extending elastic panels connected across the interior of said casing for limiting the change in shape of said casing as said flowable particles flow between said parts when a person sits on said item, and an airtight inflatable air chamber in said bottom part of said casing for compensating for reduction in said first volume resulting from crushing and/or abrading of said particles after repeated uses.

2. A freeform furniture item as defined in claim 1 including a second airtight inflatable air chamber in said casing, each of said air chambers being for compensating for reduction in said first volume of flowable particles resulting from the crushing and/or abrading of said flowable particles, and each of said air chambers includes a tube having a valve by which it can be inflated and deflated.

3. A freeform furniture item as defined in claim 1 including a second airtight inflatable air chamber, said air chambers comprising at least a first airtight inflatable air chamber and a second airtight inflatable air chamber, and one of said air chambers includes a tube having a valve by which it can be inflated and deflated, and said other air chamber is connected to said one chamber so that both of said air chambers can be inflated and deflated at the same time.

4. An item as defined in claim 1 wherein said air chamber is in engagement with the bottom part of said casing.

5. An item as defined in claim 1 wherein said at least panels are attached to said casing while said panels are in a stretched mode.

6. An item as defined in claim 1 wherein said airtight inflatable air chamber comprises a top sheet and a bottom sheet, both of said sheets being made of material that is impervious to air, and said sheets are joined to each other around their perimeters to define said air chamber.

7. An item as defined in claim 1 wherein said airtight inflatable air chamber comprises a top sheet, a bottom sheet and a side wall, both of said sheets and said side wall being made of material that is impervious to air, and said top and bottom sheets are joined to said side wall around their perimeters to define said air chamber.

8. A freeform furniture item as defined in claim 1 wherein said airtight inflatable chamber includes a tube having a valve by which it can be inflated and deflated.

9. An item as defined in claim 8 wherein said valve is a check valve.

10. A freeform furniture item comprising:

a casing comprising a flexible non-air permeable material, said casing including upper, bottom and middle parts and said middle part connecting said upper and bottom parts, a first volume of flowable particles substantially filling said casing and being movable between said parts, at least one horizontally extending and two vertically extending elastic panels being connected to different parts of the interior of said casing for limiting the change in shape of said casing as said flowable particulate moves between said parts when said item is loaded by a sitting person, and an airtight inflatable air chamber in said bottom part of said casing for compensating for reduction in said first volume resulting from crushing and/or abrading of said flowable particles after repeated uses.

11. A method of restoring the shape of a freeform furniture item that includes a casing having an interior that is substantially filled with crushable particles to substantially its original shape after the particles have been crushed, and for limiting the change in the shape of said casing when it is loaded by a sitting person comprising the steps of:

providing an inflatable air chamber in the bottom of said casing, selectively inflating and deflating said inflatable air chamber in an amount sufficient to compensate for the volume of particles lost by crushing, connecting a horizontally extending elastic panel across the interior of said casing, stretching said horizontally extending elastic panel when said casing is loaded as when a person sits on said casing, and returning said horizontally extending panel to substantially its previous size when said casing is unloaded so that the shape of said casing is restored.

12. The method as defined in claim 11 including the step of providing a second inflatable airtight chamber in said casing.

13. The method as defined in claim 11 wherein said horizontally extending panel is attached to said casing while it is in a stretched mode.

14. The method of restoring a freeform furniture item that includes a casing having an interior that is substantially filled with crushable particles to substantially its original shape after the particles have been crushed, and for limiting the change in shape of said casing when it is loaded by a sitting person comprising the steps of:

providing an inflatable air chamber in said casing, selectively inflating and deflating said inflatable air chamber in an amount sufficient to compensate for the volume of particles lost by crushing, connecting an elastic panel to different parts of the interior of said casing, stretching said elastic panel when said casing is loaded as when a person sits on said casing, returning said elastic panel to substantially its previous size when said casing is unloaded so that said shape of said casing is restored.

15. The method as defined in claim 14 including the step of providing a second inflatable airtight chamber in said casing.

16. The method as defined in claim 14 wherein said horizontally extending panel is attached to said casing while it is in a stretched mode.

* * * * *